US007844214B2

(12) United States Patent
Laiho et al.

(10) Patent No.: US 7,844,214 B2
(45) Date of Patent: Nov. 30, 2010

(54) SYSTEM AND METHOD FOR BROADBAND DIGITAL BROADCASTING

(75) Inventors: Kimmo Laiho, Turku (FI); Harri Tomberg, Raisio (FI); Juha Tomberg, Turku (FI)

(73) Assignee: Nokia Corporation (FI)

( * ) Notice: Subject to any disclaimer, the term of this patent is extended or adjusted under 35 U.S.C. 154(b) by 1446 days.

(21) Appl. No.: 10/087,437

(22) Filed: Mar. 2, 2002

(65) Prior Publication Data

US 2003/0166392 A1 Sep. 4, 2003

(51) Int. Cl.
*H04H 40/00* (2008.01)

(52) U.S. Cl. ..... 455/3.06; 455/314

(58) Field of Classification Search ..... 455/3.06, 455/3.02, 406, 424, 403, 67.1, 69, 555, 461, 455/574, 127.5, 458, 515, 3.01; 320/473; 370/311, 313, 314

See application file for complete search history.

(56) References Cited

U.S. PATENT DOCUMENTS 4,449,248 A 5/1984 Leslie et al.
4,601,586 A 7/1986 Bahr et al.
5,070,329 A * 12/1991 Jasinaki ..... 340/7.27
5,224,152 A 6/1993 Harte
5,307,376 A 4/1994 Castelain et al.
5,359,607 A 10/1994 Nguyen et al.
5,371,734 A 12/1994 Fischer
5,382,949 A 1/1995 Mock et al.
5,513,246 A 4/1996 Jonsson et al.
5,539,925 A 7/1996 Yli-Kotila et al.
5,568,513 A 10/1996 Croft et al.
5,613,235 A 3/1997 Kivari et al.
5,657,313 A 8/1997 Takahashi et al.
5,710,756 A 1/1998 Pasternak
5,732,068 A 3/1998 Takahashi et al.
5,745,860 A 4/1998 Kallin
5,764,700 A 6/1998 Mäkinen
5,799,033 A 8/1998 Baggen
5,822,310 A * 10/1998 Chennakeshu et al. ..... 370/317

(Continued)

FOREIGN PATENT DOCUMENTS

DE 199 10 023 A1 9/2000

(Continued)

OTHER PUBLICATIONS

Falk, Aaron David, "A System design For A Hybrid Network Data Communications Terminal Using Asymmetric TCP/IP to Support Internet Applications," Master of Science Thesis, 1994, 78 pages.

(Continued)

*Primary Examiner*—Tu X Nguyen
(74) *Attorney, Agent, or Firm*—Banner & Witcoff, Ltd.

(57) ABSTRACT

A system and method are disclosed for providing streaming data information to a receiver. The system accesses one or more information service providers for providing respective information signals, input buffers for storing portions of the streaming inforamtion, a digital broadcast transmitter for broadcasting the contents of the input buffers as transmission bursts, a digital broadcast receiver for receiving the transmission bursts for storage in a receiver input buffer, and an application processor for converting the transmission bursts to an information transmission stream. The digital broadcast receiver is synchronized with the transmitter broadcasts to allow for powering down between selected transmission bursts.

26 Claims, 8 Drawing Sheets

U.S. PATENT DOCUMENTS

| | | | | |
|---|---|---|---|---|
| 5,870,675 | A | 2/1999 | Tuutijärvi et al. | |
| 5,883,899 | A | 3/1999 | Dahlman et al. | |
| 5,886,995 | A | 3/1999 | Arsenault | |
| 5,915,210 | A * | 6/1999 | Cameron et al. | 455/59 |
| 5,936,965 | A | 8/1999 | Doshi et al. | |
| 5,970,059 | A | 10/1999 | Ahopelto et al. | |
| 5,995,845 | A | 11/1999 | Lardennois | |
| 6,047,181 | A | 4/2000 | Suonvieri | |
| 6,088,412 | A | 7/2000 | Ott | |
| 6,167,248 | A | 12/2000 | Hamalainen et al. | |
| 6,175,557 | B1 | 1/2001 | Diachina et al. | |
| 6,226,278 | B1 | 5/2001 | Bursztnen | |
| 6,256,357 | B1 | 7/2001 | Oshima | |
| 6,262,982 | B1 | 7/2001 | Donahue | |
| 6,262,990 | B1 | 7/2001 | Ejiri | |
| 6,266,536 | B1 | 7/2001 | Janky | |
| 6,282,209 | B1 | 8/2001 | Kataoka | |
| 6,285,686 | B1 | 9/2001 | Sharma | |
| 6,295,450 | B1 | 9/2001 | Lyer | |
| 6,298,225 | B1 * | 10/2001 | Tat et al. | 455/220 |
| 6,335,766 | B1 | 1/2002 | Twitchell et al. | |
| 6,339,713 | B1 | 1/2002 | Hansson et al. | |
| 6,356,555 | B1 | 3/2002 | Rakib et al. | |
| 6,434,395 | B1 * | 8/2002 | Lubin et al. | 455/466 |
| 6,438,141 | B1 * | 8/2002 | Hanko et al. | 370/477 |
| 6,456,845 | B1 * | 9/2002 | Drum et al. | 455/424 |
| 6,477,382 | B1 * | 11/2002 | Mansfield et al. | 455/458 |
| 6,480,912 | B1 * | 11/2002 | Safi | 710/57 |
| 6,490,727 | B1 | 12/2002 | Nazarathy et al. | |
| 6,539,237 | B1 * | 3/2003 | Sayers et al. | 455/555 |
| 6,574,213 | B1 * | 6/2003 | Anandakumar et al. | 370/349 |
| 6,674,994 | B1 * | 1/2004 | Fell et al. | 455/3.06 |
| 6,876,835 | B1 * | 4/2005 | Marko et al. | 455/3.06 |
| 6,891,852 | B1 * | 5/2005 | Cloutier et al. | 370/468 |
| 7,130,313 | B2 * | 10/2006 | Pekonen | 370/473 |
| 2001/0023184 | A1 * | 9/2001 | Kalveram et al. | 455/426 |
| 2002/0010763 | A1 | 1/2002 | Salo et al. | |
| 2002/0025777 | A1 | 2/2002 | Kawamata et al. | |
| 2002/0133647 | A1 * | 9/2002 | Kasper | 710/29 |
| 2003/0054760 | A1 * | 3/2003 | Karabinis | 455/12.1 |
| 2003/0067943 | A1 | 4/2003 | Arsenault et al. | |
| 2003/0110233 | A1 * | 6/2003 | Prall | 709/213 |
| 2003/0112821 | A1 * | 6/2003 | Cleveland et al. | 370/468 |
| 2003/0152107 | A1 * | 8/2003 | Pekonen | 370/473 |
| 2004/0097194 | A1 | 5/2004 | Karr et al. | |
| 2004/0102213 | A1 | 5/2004 | Karr et al. | |
| 2004/0102214 | A1 | 5/2004 | Karr et al. | |
| 2004/0102215 | A1 | 5/2004 | Karr et al. | |
| 2004/0242163 | A1 | 12/2004 | Karr et al. | |

FOREIGN PATENT DOCUMENTS

| | | | |
|---|---|---|---|
| DE | 101 64 665 | A1 | 8/2002 |
| EP | 0 577 322 | A1 | 1/1994 |
| EP | 0959574 | A2 | 11/1999 |
| EP | 1071221 | A1 | 1/2001 |
| EP | 1474883 | | 11/2004 |
| JP | 62 166628 | A | 7/1987 |
| JP | 04 013390 | | 1/1992 |
| JP | 62 049738 | A | 3/1994 |
| JP | 06 284041 | A | 10/1994 |
| JP | 09-037344 | | 2/1997 |
| JP | 11 331002 | A | 11/1999 |
| JP | 2001-211267 | | 3/2001 |
| JP | 2001-245339 | | 7/2001 |
| JP | 2001211267 | | 8/2001 |
| JP | 2001245339 | | 9/2001 |
| JP | 2002016581 | A | 1/2002 |
| WO | WO 00/36861 | | 6/2000 |
| WO | WO 00/67449 | | 11/2000 |
| WO | WO 01/31963 | | 5/2001 |
| WO | WO 01/72076 | | 9/2001 |
| WO | WO 02/01879 | | 1/2002 |
| WO | WO 02/03728 | | 1/2002 |
| WO | WO 02/03729 | | 1/2002 |
| WO | 03069885 | A2 | 8/2003 |

OTHER PUBLICATIONS

FT Interactive Data, printed from http://www.interactivedata.com/images/IDC_timeline.swf, on Mar. 28, 2005, 4 pages.

Ankeny, Jason, "Safe At Any Speed", printed from http://wirelessreview.com/ar/wireless_safe_speed/, on 3 pages, Wireless, Jun. 1, 2004.

"Mobility and the Implications of Wireless Technologies," printed from http://www.wws.princeton.edu/cgi-bin/byteserv.prl/~ota/disk1/1995/9547/954705.PDF chapter 2, pp. 47-64, Sep. 1995.

Welcome to eSignal!, printed from http://www.esignal.com/default.asp, on Mar. 22, 2005, 2 pages.

Welcome to the QuoTrek Product Site!, printed from http://www.quotrek.com/ on Mar. 22, 2005, 2 pages.

Vaidya, Nitin H., et al., "Scheduling data broadcast in asymmetric communication environments," Wireless Networks, vol. 5, Issue 3, May 1999, pp. 171-182.

"New Flexible Network-based RTK Service in Japan," printed from http://www.geomatics.ucalgary.ca/~lachapel/00GPSIP.pdf, 8 pages, Approximate Publication: after 1999.

"Semiconductor Delivers Complete Solution for Microsoft's New Smart Personal Objects Technology Initiative," printed from http://www.national.com/news/item/0,1735.829,00.htm on Mar. 28, 2005, 30 pages.

American Meteorological Society, "Unidata's Internet Data Distribution (IDD) System: Two Years of Data Delivery," printed from http://www.unidata.ucar.edu/projects/idd/iips97.mitch.html, 6 pages, 1997.

Unidata—IDD Principles, "Principles Underlying Internet Data Distribution," printed from http://www.unidata.ucar.edu/projects/idd/plans/principles.html 2 pages, Jun. 29, 1994.

Kellerer, W., "A Versatile Network Independent Server Architecture for Multimedia Information and Communication Services," In Proceedings of SmartNet2000, Sixth IFIP International Conference on Intelligence in Networks, Vienna, Austria, Sep. 18-22, 2000, pp. 1-20 http://www.lkn.ei.tum.de/~wolfgang/wk/publ/kellerer_smartnet00a.pdf.

Kellerer, et al., W, "IP based enhanced Data Casting Services over Radio Broadcast Networks," In Proceedings of ECUMN 2000, IEEE European Conference on Universal Multiservice Networks, Colmar, France, Oct. 2-4, 2000, 9 pages http://www.lkn.ei.tum.de/~wolfgang/wk/publ/kellerer_ecumn2000.pdf.

Imielinski , Tomasz and Badrinath, B.R., "Mobile wireless computing: challenges in data management, Communications of the ACM," vol. 37, Issue 10 (Oct. 1994), pp. 18-28, Year of Publication: 1994, ISSN:0001-0782.

Klingenberg, Wolfgang and Neutel, Andreas, "MEMO: A Hybrid DAB/GSM Communication System for Mobile Interactive Multimedia Services," Proc. of ECMAST', Berlin, Germany, 1998, Lecture Notes in Computer Science vol. 1425, Springer-Verlag Berlin Heidelberg New York, pp. 493-503 http://impact-intemal.lboro.ac.uk/memo/bosch/ecmast98.pdf.

Written Opinion from PCT/IB03/00694 dated May 3, 2004.

Nen-Fu Huang et al, "Architectures and Handoff Schemes for CATV-Based Personal Communications Network," Infocom '98. Seventeenth Annual Joint Conference of the IEEE Computer and Communications Societies. Proceedings. IEEE San Francisco, CA, USA, Mar. 29 to Apr. 2, 1998; IEEE New York, NY, USA, Mar. 29, 1998, pp. 748-755.

Draft Report of the 52nd Meeting of DVB GBS, EBU Headquarters, Geneva, Jun. 25-27, 2002. pp. 1-12.

Apostolis K. Salkintzis et al., "An In-Band Power-Saving Protocol for Mobile Data Networks", IEEE Transactions on Communications, vol. 46, No. 9, Sep. 1998, pp. 1194-1205.

Apostolis K. Salkintzis et al., "Performance Analysis of a Downlink MAC Protocol with Power-Saving Support", IEEE Transactions On Vehicular Technology, vol. 49, No. 3, May 2000, pp. 1029-1040.

Digital Video Broadcasting (DVB); DVB specification for data braodcasting, European Broadcasting Union, EN 301 192 V1.2.1 (Jun. 1999).

Japanese Office Action Dated Jun. 5, 2007, Patent Application Number 2003-573812, filed Feb. 28, 2003, 5 pages.

Office Action mailed Mar. 25, 2008 for Japanese Patent Application No. 2003-573812, 5 pages.

Office Action from Republic of the Philippines for application No. 12004501329, mailed Jul. 31, 2008, 2 pages.

* cited by examiner

Service Input Buffer X Data Characteristics

Receiver Input Buffer Data Characteristics

Service Input Buffers A-D Data Characteristics

SYSTEM AND METHOD FOR BROADBAND DIGITAL BROADCASTING

FIELD OF THE INVENTION

This invention relates to transmission of audio data, video data, control data, or other information and, in particular, to a method for efficiently using information broadcasting resources.

BACKGROUND OF THE INVENTION

Video streaming, data streaming, and broadband digital broadcast programming is increasing in popularity in network applications. One system currently in use in Europe and elsewhere world-wide is Digital Video Broadcast (DVB) which provides capabilities for delivering data in addition to televisual content. The Advanced Television Systems Committee (ATSC) has also defined a digital broadband broadcast network. Both ATSC and DVB use a containerization technique in which content for transmission is placed into MPEG-2 packets serving as data containers which can be used to transport suitably digitized data including, but not limited to, High Definition television, multiple channel Standard Definition television such as PAL/NTSC and SECAM, and broadband multimedia data and interactive services. Transmitting and receiving such programming usually requires that the equipment utilized be powered up continuously so as to be able to send or receive all the streaming information. However, in the current state of the art, power consumption levels, especially in the front end of a digital broadcast receiver or mobile terminal, are relatively high and need to be reduced to improve the operating efficiency of the broadcasting equipment.

What is needed is a system and method for more efficiently utilizing efficiently using data broadcasting resources for transmitting and receiving functions.

SUMMARY OF THE INVENTION

In a preferred embodiment, the present invention provides a system and method for providing streaming information in the form of a data signal to a mobile terminal receiver. The broadcasting system includes one or more service providers for providing streaming information, input buffers for storing successive portions of the streaming information, a digital broadcast transmitter for broadcasting the contents of the input buffers as transmission bursts, a digital broadcast receiver for receiving and storing the transmission bursts in a receiver buffer, and an application processor in the mobile terminal for converting the stored transmission bursts into an information data stream.

BRIEF DESCRIPTION OF THE DRAWINGS

The invention description below refers to the accompanying drawings, of which.

DETAILED DESCRIPTION OF THE INVENTION

Figure 1:
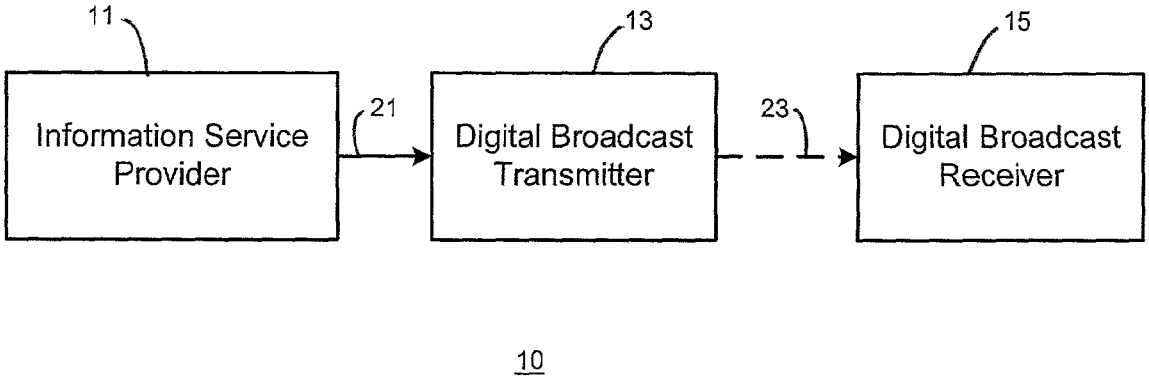
Fig. 1 (Prior Art)
FIG. 1 shows a simplified diagram of a conventional streaming digital broadcasting system.

FIG. 1 is a simplified block diagram of a conventional streaming digital broadcasting system 10 in which an information signal 21 originating at an information service provider 11 is transmitted to a client accessing a digital broadcast receiver 15. The information signal 21 is typically sent from the service provider 11 to a transmitter 13 over a link, which can be an Internet link. The transmitter 13 broadcasts the information signal to the receiver 15 as a streaming signal 23, typically by means of a broadcast antenna (not shown).

Figure 2:
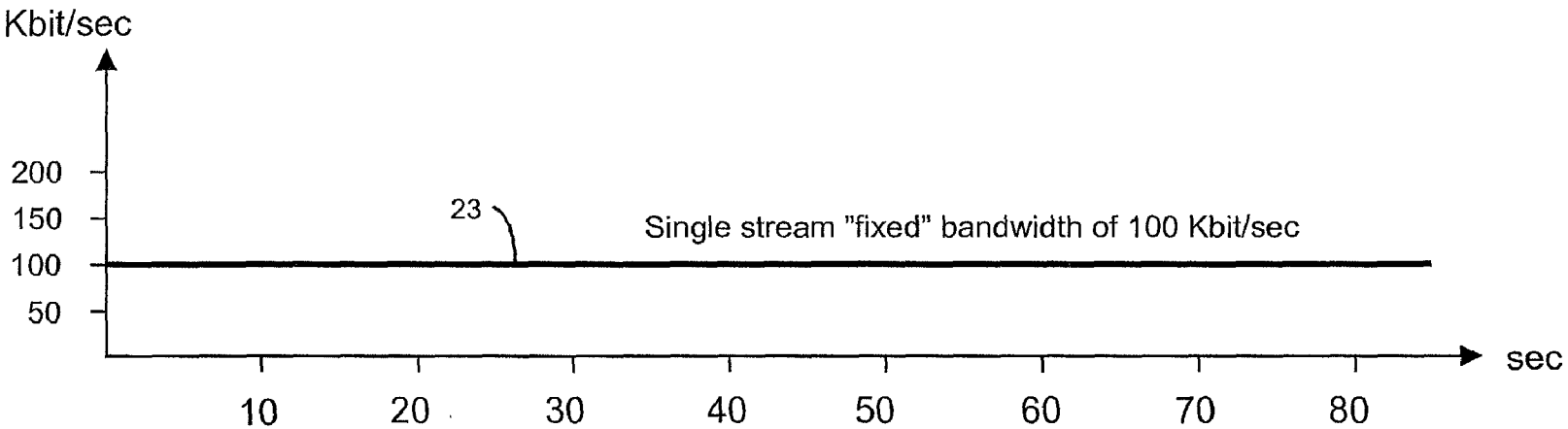
Fig. 2 (Prior Art)
FIG. 2 shows a waveform of the streaming signal output by the conventional digital broadcasting system of FIG. 1.

In a conventional signal transmission application, the transmitter 13 provides a continuous or a slowly-varying data stream having a bit rate of approximately 100 Kbit/sec, such as shown in FIG. 2. The streaming signal 23 thus exhibits the same transmission rate of 100 Kbit/sec as the information signal 21 originating at the service provider 11. The digital broadcast receiver 15 necessarily operates in a constant powered-on mode in order to receive all the information provided by the streaming signal 23, which may also include one or more other data streams provided by one or more other information service providers (not shown).

Figure 3:
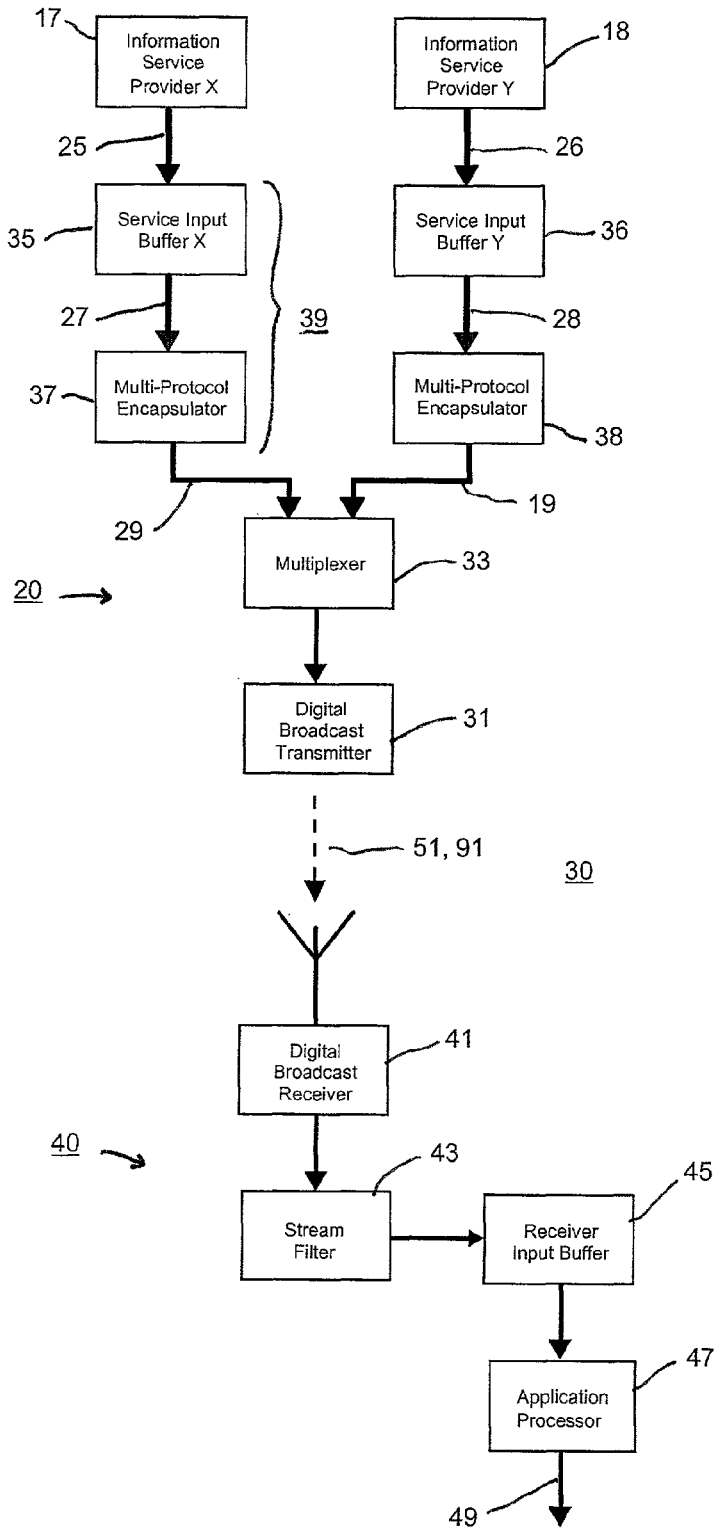
FIG. 3 shows a time-slicing digital broadcasting system in accordance with one embodiment of the present invention.

There is shown in FIG. 3 a first preferred embodiment of a time-slicing digital broadcasting system 30 including a transmitter system 20 and a mobile terminal 40. A first data signal 25 originating at a first information service provider 17 in the transmitter system 20 is made available over a network link (not shown) for downstream transmittal to a client using a digital broadcast receiver 41 in the mobile terminal 40. A predetermined interval of the streaming information in the data signal 25 is initially buffered in a first service input buffer 35 as buffered data 27. The first service input buffer 35 may be, for example, a first-in, first-out (FIFO) buffer, an elastic buffer, a ring buffer, or a dual buffer having separate input and output sections.

In a preferred embodiment, the buffered data 27 is then formatted by using, for example, a multi-protocol encapsulator 37 in accordance with Section 7 of European Standard EN 301192 "Digital Video Broadcasting (DVB); DVB specification for data broadcasting." In an alternative embodiment, the first service input buffer 35 is integrated with the multi-protocol encapsulator 37 to comprise a single input device 39. Encapsulated data 29 is sent by the multi-protocol encapsulator 37 to a digital broadcast transmitter 31 for broadcast to the digital broadcast receiver 41 as a time-slicing signal 51 described in greater detail below.

Figure 4:
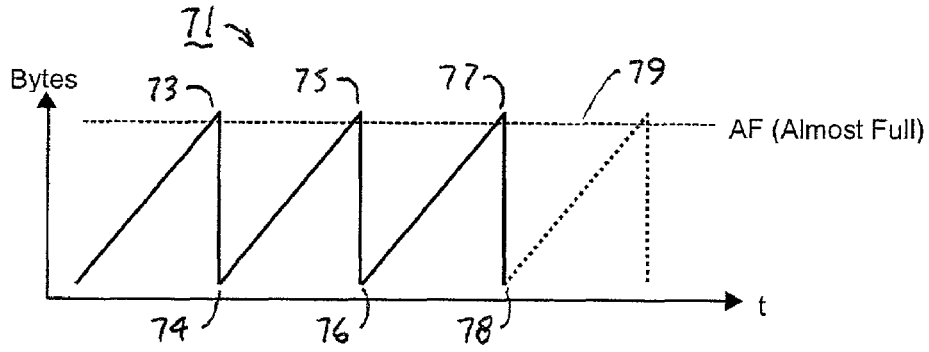
FIG. 4 is a graph showing changes over time in the contents of a service input buffer in the broadcasting system of FIG. 3 in accordance with one embodiment of the present invention.

The amount of information retained in the first service input buffer 35 as a function of time can be represented by a sawtooth waveform 71 shown in the graph of FIG. 4. As the first service provider 17 supplies the data signal 25, the data information present in the first service input buffer 35 increases to a buffer maximum level, here denoted by a first local maximum value 73. The first local maximum value 73 is a function of the amount of memory designated in the first service input buffer 35 for storing the first information signal.

The size of the first service input buffer 35 is generally specified to be large enough to store the data received from an information stream in the time interval between successive waveform maxima (e.g., data received in the time interval between the first local maximum value 73 and a second local maximum value 75). The buffered data 27 stored in the first service input buffer 35 is periodically sent via the multi-protocol encapsulator 37 to the digital broadcast transmitter 31. Because the contents of the first service input buffer 35 is thus periodically transferred, subsequent incoming data will not cause the specified memory capacity to be exceeded. When the buffered data 27 is sent to the digital broadcast transmitter 31, the quantity of buffered information remaining in the first service input buffer 35 drops to a local minimum value 74, which can be zero.

The first service input buffer 35 may include an 'AF' flag which can be set when an "almost full" byte count 79 is reached to indicate when the first service input buffer 35 is about to exceed the designated memory capacity. Preferably, the process of outputting the buffered data 27 begins when the AF flag is set. This serves to provide storage capacity for a subsequent interval of the streaming information sent by the service provider 17 (here represented by the next part of the waveform 71). When the next streaming data information interval has been inputted, the buffered information in the first service input buffer 35 reaches a second local maximum value 75 which is subsequently outputted when the AF flag is set, resulting in a second local minimum value 76. The process is repeated, yielding a third local maximum value 77 and a third local minimum value 78.

Figure 5:
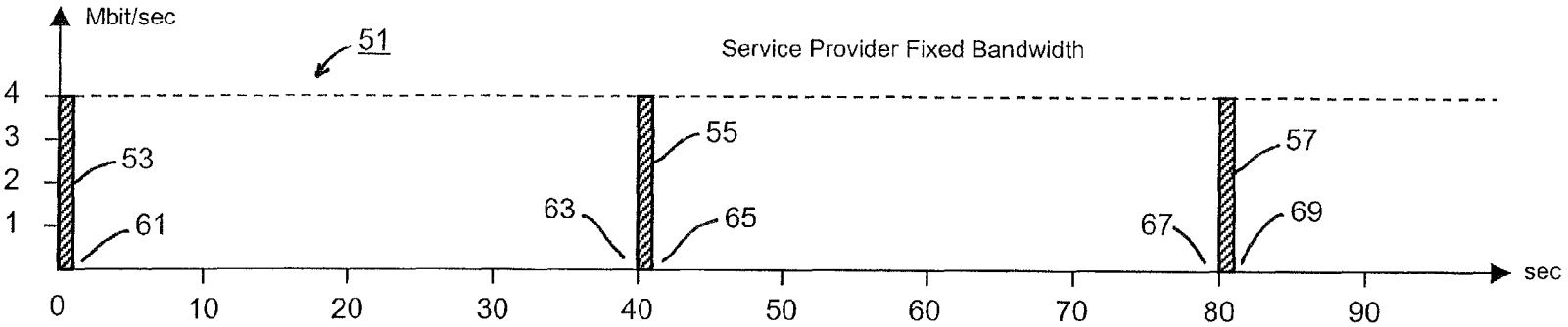
FIG. 5 shows the transmission waveform of a signal output by the digital broadcast transmitter in the system of FIG. 3 in accordance with one embodiment of the present invention, the signal including information obtained from one of the information service providers.

Each subsequent portion of the streaming data buffered in the first service input buffer 35 is thus successively outputted to the digital broadcast transmitter 31 for transmission to the digital broadcast receiver 41. This action produces the time-slicing signal 51, a portion of which is shown in FIG. 5. The time-slicing signal 51 comprises a continuous series of transmission bursts, exemplified by transmission bursts 53, 55, and 57. In the example provided, the transmission burst 53 corresponds to the buffered information transfer represented by the transition of the waveform 71 from the local maximum value 73 to the local minimum value 74. Likewise, the next transmission burst 55 corresponds to the buffered information transfer represented by the transition of the waveform 71 from the local maximum value 75 to the local minimum value 76, and the transmission burst 57 corresponds to the buffered information transfer represented by the transition from the local maximum value 77 to the local minimum value 78.

In a preferred embodiment, each of the transmission bursts 53, 55, and 57 is a 4-Mbit/sec pulse approximately one second in duration to provide a transfer of four Mbits of buffered information per transmission burst. The transmission bursts 53, 55, and 57 are spaced at approximately 40-second intervals such that the time-slicing signal 51 effectively broadcasts at an average signal information transmittal rate of 100 Kbits per second (i.e., the same as the transmittal rate of the incoming streaming signal 23). The 40-second signal segment stored in the input buffer 35 comprises the signal information to be broadcast to the digital broadcast receiver 41 as any one of the transmission bursts 53, 55, and 57, for example.

In FIG. 3, the digital broadcast receiver 41 sends the time-slicing signal 51 to a stream filter 43 to strip the encapsulation from the information signal which had been added by the multi-protocol encapsulator 37. The encapsulation may conform to Internet Protocol (IP) standards, for example. In a preferred embodiment, Boolean protocol filtering is used to minimize the amount of logic needed for filtering operations performed by the stream filter 43, and thus optimize the capacity of the digital broadcast receiver 41.

Figure 6:
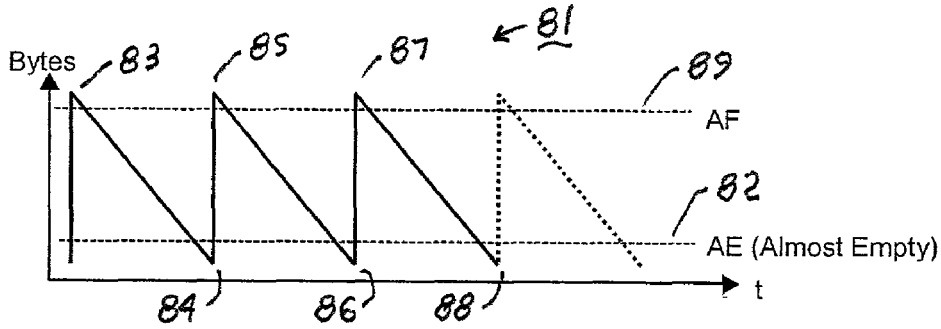
FIG. 6 is a graph showing changes over time in the contents of the receiver input buffer in the broadcasting system of FIG. 3 in accordance with one embodiment of the present invention.

Filtered data is then sent to a receiver input buffer 45. The receiver input buffer 45 functions to temporarily store filtered data, which may comprise any one of the transmission bursts 53, 55, and 57, before being sent downstream to an application processor 47 for conversion into an information data stream 49. This process can be illustrated with reference to the graph of FIG. 6 in which sawtooth waveform 81 diagrammatically represents as a function of time the quantity of filtered data stored in the receiver input buffer 45. Preferably, the size of the receiver input buffer 45 in the mobile terminal 40 is substantially the same as the size of the first service input buffer 35 in the transmitter system 20.

In an alternative preferred embodiment, the receiver input buffer 45 adapts to the configuration of the service input buffer 35, wherein the portion of the service input buffer 35 designated for storage of the incoming data stream may vary according to the characteristics of the streaming information selected from a particular information service provider. That is, the selected information service provider may be supplying a data stream that can be stored using only a part of the storage resources available in the service input buffer 35 (i.e. a 'usage factor' of less than unity). In one alternative embodiment, this usage factor information is provided to the mobile terminal 40 as part of the time-slicing signal 51 to allow the receiver input buffer 45 to anticipate and adapt to the smaller quantity of transmitted data to be provided in a transmittal. In another alternative embodiment, the usage factor information is not provided to the mobile terminal 40 as part of the time-slicing signal 51. Rather, the mobile terminal 40 continues to receive data from the transmitter system 20 and, over a period of time, derives the usage factor by determining the portion of storage resources needed in the receiver input buffer 45 for the data being provided by the selected service provider.

When turning on the digital broadcast receiver 41 for the purpose of initially receiving a service which has a small bit rate, the digital broadcast receiver 41 will experience a relatively long period between subsequent bursts. Because the actual bit rate is not initially known, the digital broadcast receiver 41 may remain powered up for a period of time beyond that required for receipt of the initial small-bit-rate service signal burst. The consumer may then need to wait for the requested service to 'start up.' However, when a smaller quantity of data is designated for storage in the receiver input buffer 45 (i.e., when the usage factor is less than unity), the digital broadcast receiver 41 can receive the first burst earlier, that is with a minimum of delay, and service start-up time can be reduced accordingly by utilizing the usage factor information.

When the transmission burst 53 has been received in the receiver input buffer 45, the waveform 81 reaches a first local maximum 83. The byte count stored in the receiver input buffer 45 then decreases from the first local maximum 83 to a first local minimum 84 as corresponding data is transferred from the receiver input buffer 45 to the application processor 47. Preferably, the rate at which the contents of the receiver input buffer 45 is transferred to the application processor 47 is at least as great as the rate at which data information is placed into the first service input buffer 35. This serves to insure that the receiver input buffer 45 is available to store the next transmission burst 55. When the next transmission burst 55 is received at the receiver input buffer 45, the waveform 81 increases to a second local maximum 85 which decreases to a second local minimum 86 as the received information interval is transferred from the receiver input buffer 45 to the application processor 47 for conversion to a data packet.

The process continues with the next transmission burst 57 producing a third local maximum 87 which decreases to a third local minimum 88. Preferably, the receiver input buffer 45 includes an "AE" flag to indicate when an "almost empty" byte count 82 has been reached and an AF flag to indicate when an "almost full" byte count 89 has been reached. As explained in greater detail below, the AE and AF flags can be advantageously utilized to synchronize the powering up and the powering down respectively of the digital broadcast receiver 41 to correspond with the timing of incoming transmission bursts, such as the transmission bursts 53, 55, and 57.

The application processor 47 functions to continuously input buffer data from the receiver input buffer 45 and to continuously reformat the buffered data into the information data stream 49. As can be appreciated by one skilled in the relevant art, while the digital broadcast transmitter 31 remains powered-up in a transmission mode during each transmission burst 53, 55, and 57, the digital broadcast transmitter 31 can be advantageously powered down in the 'idle' time intervals between the transmission bursts 53 and 55, and between the transmission bursts 55 and 57 to reduce operational power requirements. Powering down can be accomplished, for example, by a controlled switch as is well-known in the relevant art.

In particular, the digital broadcast transmitter 31 can be powered down after termination point 61 of transmission burst 53 (shown at t=1 sec), and can remain powered-down until just before initiation point 63 of transmission burst 55 (shown at t=40 sec). Similarly, the digital broadcast transmitter 31 can power down after termination point 65 of transmission burst 55 (shown at t=41 sec), and can remain powered-down until just before initiation point 67 of transmission burst 57 (shown at t =80 sec). At the completion of the transmission burst 57, indicated as termination point 69 (shown at t=81 sec), the digital broadcast transmitter 31 can again be powered down if desired.

In an alternative preferred embodiment, the time-slicing digital broadcasting system 30 includes one or more additional service providers, exemplified by a second service provider 18, shown in FIG. 3. The second service provider 18 sends a second data signal 26 to the digital broadcast transmitter 31 over a network link (not shown). The second data signal 26 received from the second service provider 18 is placed into a second service input buffer 36 and encapsulated using, for example, a multi-protocol encapsulator 38, as described above. A multiplexer 33 processes the encapsulated signals 29 from the first service input buffer 35 with encapsulated signals 19 from the second service input buffer 36 into a time-division multiplexed (TDM) signal 91, described in greater detail below, for broadcast to the digital broadcast receiver 41. As used herein, broadcasting may include multicasting or unicasting.

It should be understood that if only one service provider is sending information to the digital broadcast transmitter 31, the first service provider 17 for example, the multiplexer 33 is not required for operation of the time-slicing digital broadcasting system 30. Accordingly, in the first preferred embodiment, above, the signal in the first service input buffer 35 can be provided directly to the digital broadcast transmitter 31 via the multi-protocol encapsulator 37.

Figure 7:
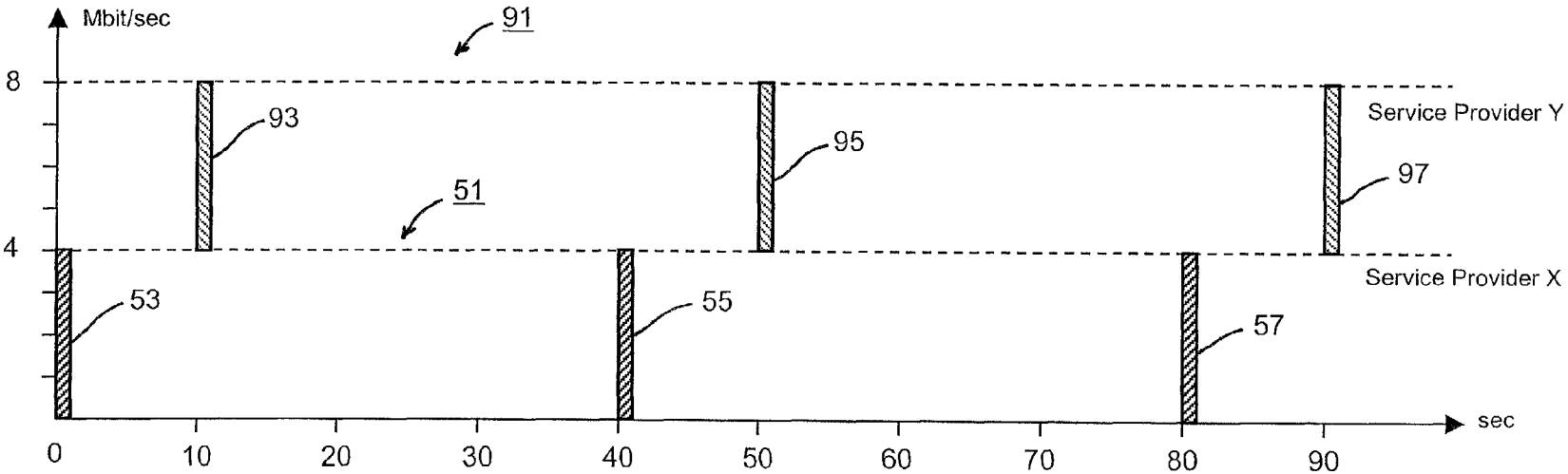
FIG. 7 shows the transmission waveform of a time-division multiplexed signal output by the digital broadcast transmitter in the system of FIG. 3 in accordance with one embodiment of the present invention, the multiplexed signal including information obtained from both of the information service providers.

For the alternative preferred embodiment shown in FIG. 3, in which two service providers are supplying information signals, the TDM signal 91, shown in FIG. 7, comprises a continuous series of transmission bursts, including transmission bursts 53, 55, and 57 resulting from information signals provided by the first service input buffer 35, interlaced with transmission bursts 93, 95, and 97 resulting from information signals provided by the second service input buffer 36. In the example provided, each of the transmission bursts 93, 95, and 97 occurs approximately ten seconds after a corresponding transmission burst 53, 55, or 57. As can be appreciated by one skilled in the relevant art, the disclosed method is not limited to this ten-second spacing and other transmission intervals can be used as desired. In particular, the transmission interval between the transmission bursts 93, 95, and 97 can be greater or less than ten seconds. Moreover, if additional service providers are included in the time-slicing digital broadcasting system 30, one or more sets of interlaced transmission bursts (not shown) will be included in the TDM signal 91.

In a preferred embodiment, the powered-up receive mode of the digital broadcast receiver 41, in FIG. 3, is synchronized with a transmission window during which period the digital broadcast transmitter 31 is transmitting. Thus, for receipt of the time-slicing signal 51, for example, the digital broadcast receiver 41 remains powered-up in a receive mode during each incoming transmission burst 53, 55, and 57 and can be powered down in the time intervals between the transmission bursts 53 and 55, and between the transmission bursts 55 and 57. In an alternative embodiment, the stream filter 43 is also synchronized to maintain a powered-up mode with the transmission window.

In way of example, such synchronization can be achieved by using burst sizes of either fixed or programmable size, and by using the AE flag and "almost empty" byte count 82, above, as a criterion to power up the digital broadcast receiver 41 and prepare to receive the next transmission burst after fixed or slowly-varying time intervals. That is, the digital broadcast receiver 41 acquires information intermittently broadcast as described above. The client may also configure the digital broadcast receiver 41 to take into account any transmission delays resulting from, for example, a bit rate adaptation time, a receiver switch-on time, a receiver acquisition time, and/or a bit-rate variation time interval. A typical value for the adaptation time may be about 10 μsec, and for the switch-on times or acquisition times a typical value may be about 200 msec. The digital broadcast receiver 41 is thus configured to power-up sufficiently in advance of an incoming burst to accommodate the applicable delay factors. Similarly, the AF flag and the "almost full" byte count 89, above, can be used as a criterion to power-up the digital broadcast receiver 41.

Figure 9:
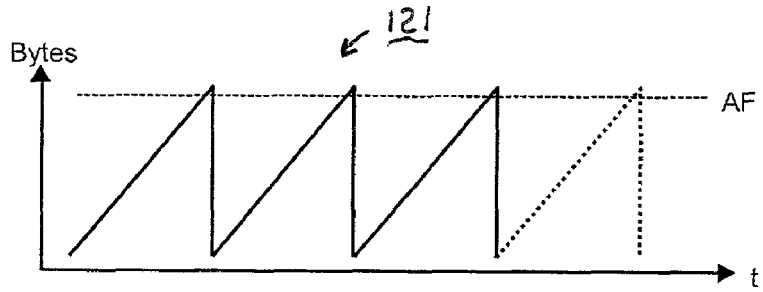
FIG. 9 is a graph showing changes over time in the contents of a service input buffer in the broadcasting system of FIG. 8 in accordance with one embodiment of the present invention.
Figure 8:
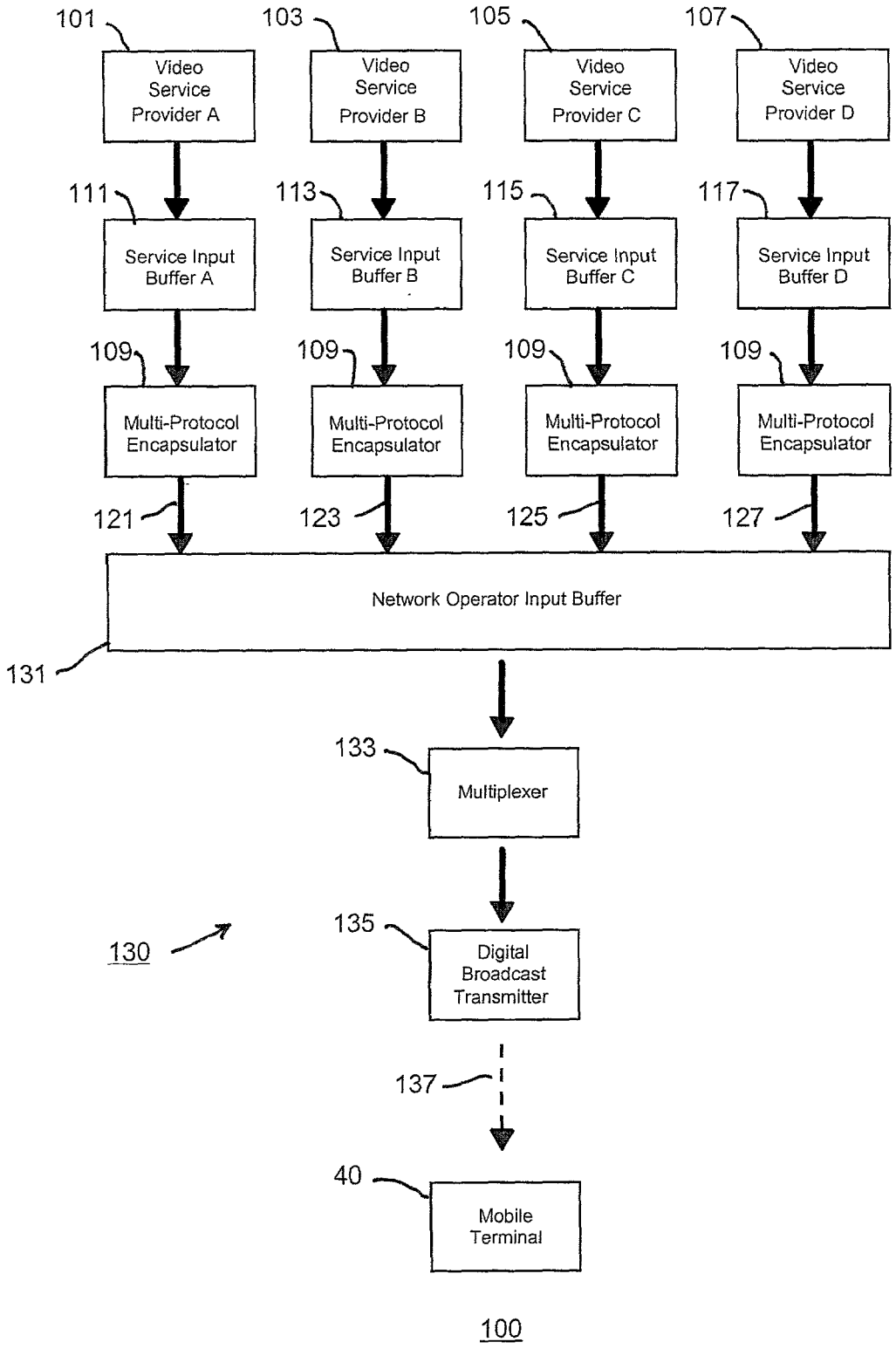
FIG. 8 shows an alternative preferred embodiment of a time-slicing digital broadcasting system.

In yet another alternative preferred embodiment, a TDM digital broadcasting system 100 includes a transmitter system 130 and the mobile terminal 40, shown in FIG. 8. the digital broadcasting system 100 further includes a plurality of service providers 101-107 sending respective information streams to corresponding service input buffers 111-117. The outputs of each of the service input buffers 111-117 are formatted by means of a plurality of multi-protocol encapsulators 109 as described above. The encapsulated data 121-127 output from the respective multi-protocol encapsulators 109 are provided to a network operator input buffer 131 as shown. The size of the data stored in any of the service input buffers 111-117 is a function of time, as represented by sawtooth waveform 121 in FIG. 9.

Figure 10:
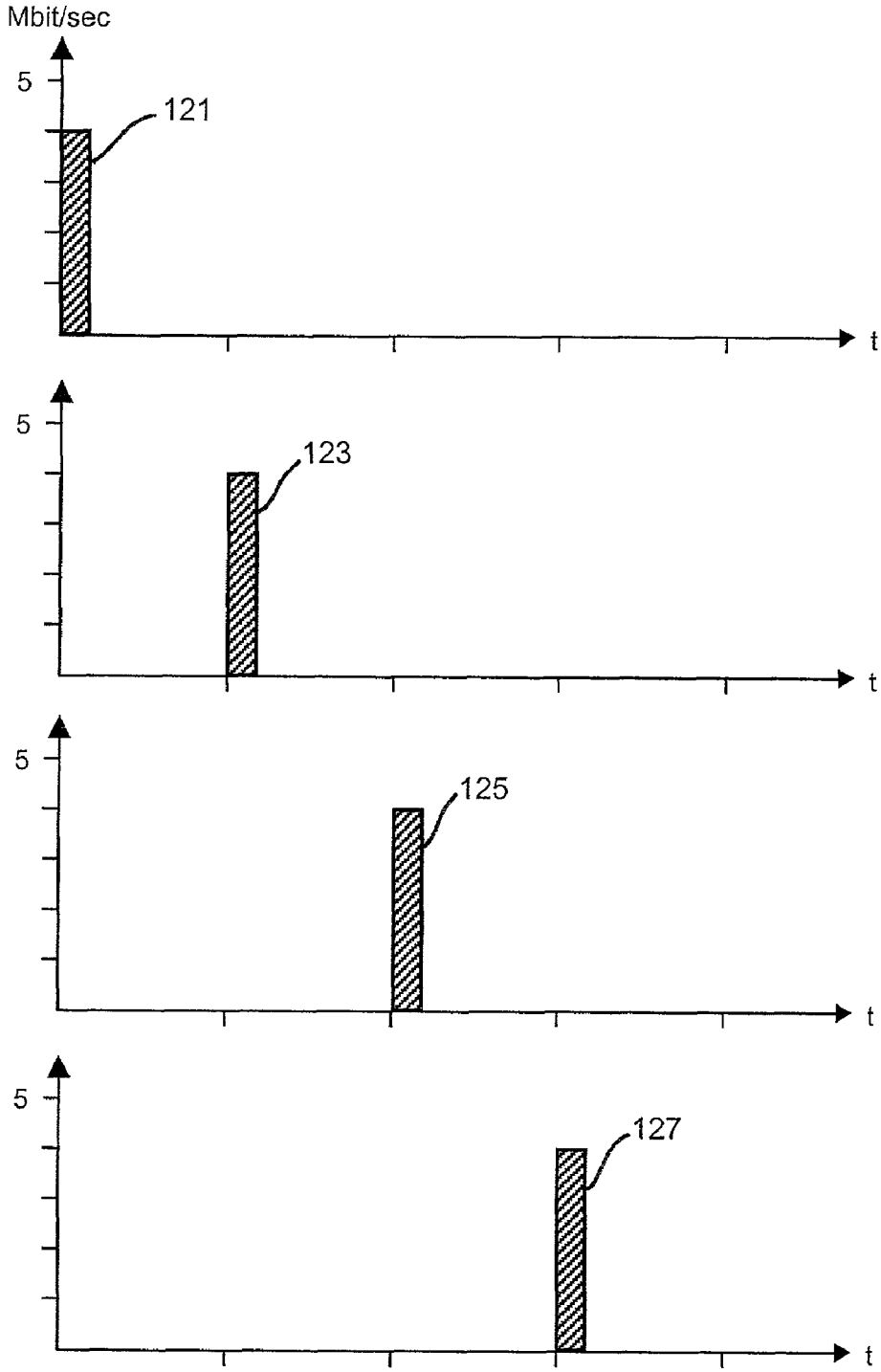
FIG. 10 is a series of graphs showing transmission waveforms of signals output by the multi-protocol encapsulators in the broadcasting system of FIG. 8 in accordance with one embodiment of the present invention.

The network operator input buffer 131 stores a predetermined amount of buffered data from each of the service input buffers 111-117. The data is provided to a multiplexer 133 and sent to a digital broadcast transmitter 135 for broadcast as a TDM signal 137. The network operator input buffer 131 functions to receive and store multiple inputs from each of the service input buffers 111-117 before outputting to the multiplexer 133. For example, FIG. 10 illustrates the data input to the network operator input buffer 131 where the encapsulated data 121 is received from the service input buffer 111, the encapsulated data 123 is received from the service input buffer 113, the encapsulated data 125 is received from the service input buffer 115, and the encapsulated data 127 is received from the service input buffer 117. It should be understood that while the encapsulated data 121-127 waveforms are shown as being spaced at regular intervals for clarity of illustration, the invention is not limited to this transmission mode. Accordingly, other various transmission intervals can be used and the transmission rates of the encapsulated data 121-127 waveforms can be dissimilar from one another.

Figure 11:
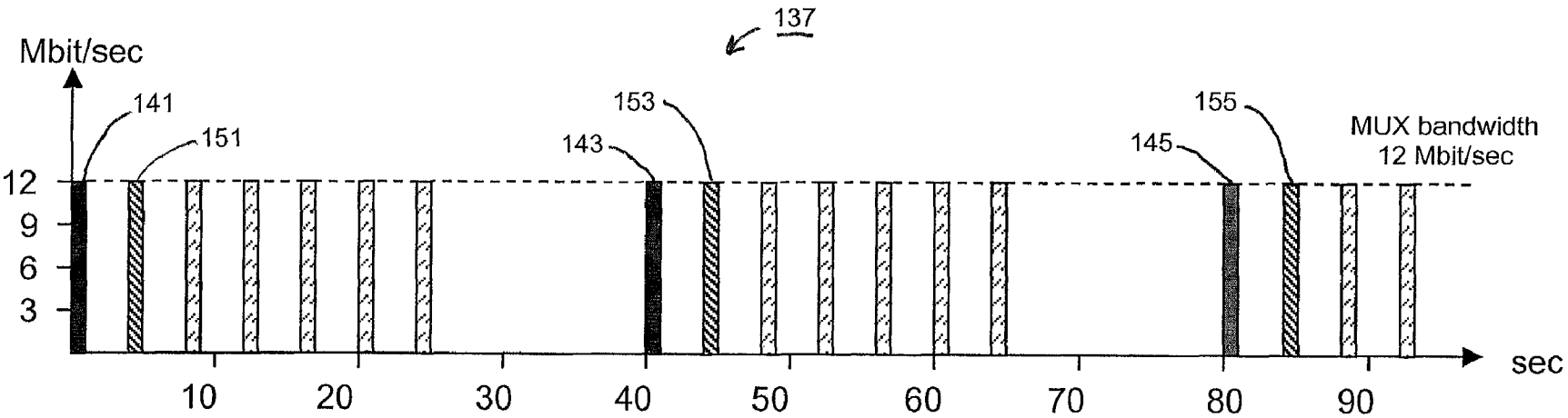
FIG. 11 shows the transmission waveform of a time-division multiplexed signal output by the digital broadcast transmitter in the system of FIG. 8 in accordance with one embodiment of the present invention.

One example of a TDM signal 137 broadcast by the digital broadcast transmitter 135 is shown in FIG. 11 where the information stream provided by the service provider 101 appears as transmission bursts 141, 143, and 145 (here shown with solid fill for clarity). In an embodiment having a multiplexer bandwidth of approximately 12 Mbit/sec, the transmission bursts 141, 143, and 145 can be configured as 12-Mbit/sec bursts of approximately one-second duration. The transmission burst 141, for example, may comprises three 4-Mbit/sec transmission bursts provided to the network operator input buffer 131 by the service input buffer 111. A subsequent 12-Mbit/sec transmission burst 151 may comprise three 4-Mbit/sec transmission bursts provided to the network operator input buffer 131 by the service input buffer 113. In an alternative embodiment, the transmission burst 141, for example, can have a duration of greater or less than one second, and can comprise more or less than three incoming transmission bursts. If additional bandwidth is required because additional service providers are included, or if the amount of data being transmitted by the service providers 101-107 increases substantially, additional transmission channels (not shown) can be provided for use in the TDM digital broadcasting system 100.

In a preferred embodiment, the transmission bursts originating with a particular service provider may comprise a unique data stream. For example, the transmission bursts 141, 143, and 145 may comprise a first data stream, originating at the service provider 101, where the data stream has a burst-on time of about 333 msec and a burst-off time of about 39.667 sec. The first data stream comprises subsequent transmission bursts occurring precisely every forty seconds (not shown), each transmission burst including information originating at the service provider 101. Similarly, the transmission burst 151 comprises a second data stream along with transmission bursts 153, 155, and subsequent transmission bursts (not shown) occurring every forty seconds, where the second data stream includes information originating at the service provider 103. In one alternative embodiment, the digital broadcast receiver 41 is synchronized to selectively receive only the first data stream, for example. Accordingly, in this embodiment the digital broadcast receiver 41 is powered-up for at least 333 msec every forty seconds to receive the transmission bursts 141, 143, 145, and subsequent first-data-stream transmission bursts, and powered down in the interval time periods.

While the invention has been described with reference to particular embodiments, it will be understood that the present invention is by no means limited to the particular constructions and methods herein disclosed and/or shown in the drawings, but also comprises any modifications or equivalents within the scope of the claims.

We claim:

1. A method comprising:

receiving, at a mobile terminal, buffered data as a digital video broadcast transmission burst in a time-slicing signal, the buffered data corresponding to a first portion of an information stream, said digital video broadcast transmission burst having a duration smaller than the duration of said first portion of said information stream;

powering-up a digital video broadcast receiver in the mobile terminal in synchronicity with the transmission of said digital video broadcast transmission burst such that the mobile terminal is powered-up when said digital video broadcast transmission burst is being received; and buffering said digital video broadcast transmission burst in a receiver input buffer of the digital video broadcast receiver.

2. A method as in claim 1 wherein the buffered data is transmitted from a service input buffer comprising at least one member of the group consisting of: a first-in-first-out (FIFO) buffer, an elastic buffer, a ring buffer, and a dual buffer having separate input and output sections.

3. A method as in claim 1 wherein said buffered data comprises at least one of: a predetermined amount of said information stream and an amount of said information stream received during a predetermined time interval.

4. A method as in claim 1 wherein said powering-up said receiver occurs a specified interval of time prior to said receiving.

5. A method as in claim 4 wherein said specified interval of time comprises a member of the group consisting of: a bit-rate adaptation time, a receiver switch-on time, and a receiver acquisition time.

6. A method as in claim 1 further comprising powering-down said receiver a predefined interval of time subsequent to said powering-up said receiver.

7. A method as in claim 6 wherein said predefined interval of time comprises a time interval greater than said duration of said transmission burst.

8. A method as in claim 1 wherein the buffered data is encapsulated using a multi-protocol encapsulator to form encapsulated data.

9. A method as in claim 8 wherein said multi-protocol encapsulator conforms to standard EN 301192.

10. A method as in claim 8 further comprising:

obtaining said transmission burst from said receiver input buffer; and stripping encapsulation from said transmission burst to form received data.

11. A method as in claim 10 further comprising sending said received data to an application processor for conversion to an information data stream.

12. A method as in claim 1 further comprising:

receiving a second buffered data as a second digital video broadcast transmission burst, said second digital video broadcast transmission burst having a duration smaller than the duration of said portion of said second information stream, wherein the second buffered data comprises a portion of a second information stream.

13. A method as in claim 12 wherein the transmission burst and said second transmission burst are multiplexed to produce a time-division multiplexed signal.

14. The method of claim 1, wherein the streaming information comprises multimedia content.

15. An apparatus comprising:

a processor configured to:

receive buffered data as a digital video broadcast transmission burst in a time-slicing signal, the buffered data corresponding to a first portion of an information stream, said digital video broadcast transmission burst having a duration smaller than the duration of said first portion of said information stream;

power-up a digital video broadcast receiver in synchronicity with the transmission of said digital video broadcast transmission burst such that the apparatus is powered-up when said digital video broadcast transmission burst is being received; and buffer said digital video broadcast transmission burst in a receiver input buffer.

16. The apparatus as in claim 15 wherein the digital video broadcast receiver is powered-up a specified period of time subsequent to a pre-determined powered-down time.

17. The apparatus as in claim 15 wherein the digital video broadcast receiver is powered-up an incremental period of time prior to the transmission of the digital video broadcast transmission burst.

18. The apparatus as in claim 17 wherein said incremental period of time comprises a member of the group consisting of: a bit rate adaptation time, a receiver switch-on time, a receiver acquisition time, and a bit-rate variation time interval.

19. The apparatus as in claim 15 wherein the digital video broadcast receiver is powered-down a specified period of time subsequent to the powering up of the digital video broadcast receiver.

20. The apparatus as in claim 19 wherein said specified period is at least as great as said transmission burst duration.

21. The apparatus as in claim 15 wherein the digital video broadcast receiver is powered-down at the setting of a flag indicating an almost-full byte count in said receiver input buffer.

22. The apparatus as in claim 15 wherein the digital video broadcast receiver is powered-down an incremental period of time subsequent to the transmission of said digital video broadcast transmission burst.

23. The apparatus as in claim 15 wherein the processor is further configured to convert said digital video broadcast transmission burst into an information data stream.

24. The apparatus as in claim 15 further comprising a stream filter for stripping encapsulation from said digital video broadcast transmission burst.

25. The apparatus as in claim 24 wherein said stream filter comprises an Internet protocol (IP) filter.

26. An apparatus comprising:

means for receiving buffered data as a digital video broadcast transmission burst in a time-slicing signal, the buffered data corresponding to a first portion of an information stream, said digital video broadcast transmission burst having a duration smaller than the duration of said first portion of said information stream;

means for powering-up a digital video broadcast receiver in synchronicity with the transmission of said digital video broadcast transmission burst such that the apparatus is powered-up when said digital video broadcast transmission burst is being received; and means for buffering said digital video broadcast transmission burst in a receiver input buffer.

* * * * *

UNITED STATES PATENT AND TRADEMARK OFFICE

CERTIFICATE OF CORRECTION

PATENT NO. : 7,844,214 B2
APPLICATION NO. : 10/087437
DATED : November 30, 2010
INVENTOR(S) : Kimmo Laiho et al.

It is certified that error appears in the above-identified patent and that said Letters Patent is hereby corrected as shown below:

On the Title page, under Inventors (75)
Please delete "Harri TOMBERG" and insert --Harri PEKONEN--

Title page 2, under U.S. PATENT DOCUMENTS
Please delete "Bursztnen" and insert --Bursztejn et al.--

Signed and Sealed this
Sixteenth Day of August, 2011

David J. Kappos

David J. Kappos
*Director of the United States Patent and Trademark Office*